US006684484B2

(12) United States Patent
Collins

(10) Patent No.: US 6,684,484 B2
(45) Date of Patent: Feb. 3, 2004

(54) METHOD FOR MANUFACTURING ACOUSTICAL TRANSDUCER WITH REDUCED PARASITIC CAPACITANCE

(75) Inventor: James Steven Collins, Elk Grove Village, IL (US)

(73) Assignee: Knowles Electronics, LLC, Itasca, IL (US)

( * ) Notice: Subject to any disclaimer, the term of this patent is extended or adjusted under 35 U.S.C. 154(b) by 92 days.

(21) Appl. No.: 09/928,672

(22) Filed: Aug. 13, 2001

(65) Prior Publication Data

US 2002/0021816 A1 Feb. 21, 2002

Related U.S. Application Data

(62) Division of application No. 09/500,202, filed on Feb. 8, 2000, now Pat. No. 6,532,293.

(51) Int. Cl.[7] ..... H01R 43/06; H01R 43/10

(52) U.S. Cl. ..... 29/597; 29/594; 29/602.1; 29/832; 29/846; 156/290; 381/174; 381/191

(58) Field of Search ..... 29/594, 597, 602.1, 29/609.1, 832, 846; 367/170; 381/174, 191; 156/290

(56) References Cited

U.S. PATENT DOCUMENTS

| | | | | |
|---|---|---|---|---|
| 2,425,481 A | | 8/1947 | Morse | 360/356 |
| 3,588,382 A | | 6/1971 | Reedyk | 381/174 |
| 4,063,050 A | | 12/1977 | Carlson et al. | 367/181 |
| 4,085,297 A | * | 4/1978 | Paglia | 381/191 |
| 4,234,811 A | | 11/1980 | Hishida et al. | 381/174 |
| 4,310,906 A | | 1/1982 | Cantrell, Jr. et al. | 367/181 |
| 4,321,432 A | | 3/1982 | Matsutani et al. | 307/400 |
| 4,701,640 A | | 10/1987 | Flygstad et al. | 307/400 |
| 4,730,283 A | | 3/1988 | Carlson et al. | 367/170 |
| 5,255,246 A | * | 10/1993 | van Halteren | 367/170 |
| 5,490,220 A | * | 2/1996 | Loeppert | 381/355 |
| 5,548,658 A | | 8/1996 | Ring et al. | 381/191 |
| 5,801,452 A | * | 9/1998 | Farnworth et al. | 257/797 |
| 6,077,723 A | * | 6/2000 | Farnworth et al. | 438/107 |
| 6,169,810 B1 | | 1/2001 | van Halteren et al. | 381/174 |
| 6,178,249 B1 | | 1/2001 | Hietanen et al. | 381/174 |
| 6,332,567 B1 | * | 12/2001 | Ikegami et al. | 228/179.1 |

FOREIGN PATENT DOCUMENTS

| | | |
|---|---|---|
| EP | 0533284 A1 | 3/1993 |
| EP | 0 553 284 B1 | 3/1993 |
| JP | 10136492 | 5/1998 |
| WO | WO-84/01683 | 4/1984 |
| WO | WO 84/01683 | 4/1984 |

* cited by examiner

*Primary Examiner*—Peter Vo
*Assistant Examiner*—Paul D Kim
(74) *Attorney, Agent, or Firm*—Marshall, Gerstein & Borun LLP

(57) ABSTRACT

A method for manufacturing a motor assembly for an acoustic transducer is provided. The motor assembly includes a base member, a support member, a diaphragm and a backplate. The base member has a surface and a protrusion extending a distance from the surface. The support member has an opening therethrough, and the diaphragm is connected to the support member such that the diaphragm covers a portion of the opening of the support member. The support member is placed on the base member such that the support member contacts the surface of the base member, and the protrusion of the base member contacts the diaphragm. The backplate is placed on the diaphragm such that the backplate is supported by the protrusion. As part of the assembly, the backplate is secured to the support member. By having an assembly wherein the backplate does not contact the diaphragm, the capacitance of the assembly is reduced.

8 Claims, 3 Drawing Sheets

METHOD FOR MANUFACTURING ACOUSTICAL TRANSDUCER WITH REDUCED PARASITIC CAPACITANCE

RELATED APPLICATIONS

This application is a divisional of U.S. patent application Ser. No. 09/500,202, filed Feb. 8, 2000 now U.S. Pat. No. 6,532,293, upon which a claim of priority is based.

TECHNICAL FIELD

The present invention relates generally to a method for manufacturing acoustic transducers, and, more particularly, to a method for manufacturing motor assemblies for microphones to reduce parasitic capacitance.

BACKGROUND OF THE INVENTION

Transducers and particularly microphones are typically utilized in hearing-aids. Generally, electret transducers comprise a casing having an opening which communicates with the interior of the case. An electret assembly including a diaphragm adjacent a charged plate having an electret material formed thereon is mounted within the case to form acoustic chambers on opposite sides of the diaphragm.

Acoustic signals enter one of the acoustic chambers allowing the diaphragm to respond thereto. Air pulsations created by the vibrations of the diaphragm pass from one acoustic chamber to the other acoustic chamber.

The electret material on the charged plate is connected to suitable electronic circuitry to permit electroacoustical interaction of the diaphragm and electret material on the backplate to provide an electrical signal representative of the acoustic signal. As is known, the converse operation may be provided by the transducer in that an electrical signal may be applied to the electret on the backplate to cause the diaphragm to vibrate and thereby to develop an acoustic signal which can be coupled out of the acoustic chamber.

In a transducer of the subject type, it is always a problem to reduce or minimize the parasitic capacitances, i.e. the capacitances that do not vary proportionally to the variation in the air vibrations but are stationary and are determined by the construction of the transducer. Specifically, in electret transducers and microphones, parasitic capacitances are present wherever the capacitance formed by the charged plate and the diaphragm cannot move under the influence of air vibrations. Typically, in the above-identified transducers parasitic capacitances are caused by the protrusions or bumps which maintain proper spacing between the diaphragm and charged plate.

Accordingly, a method for manufacturing an acoustical transducer in accordance with the present invention provides an inexpensive and simple solution to eliminate the drawbacks of the prior acoustical transducers.

SUMMARY OF THE INVENTION

The transducer of the present invention is adapted to provide an electret assembly, also referred to as a motor assembly, including a diaphragm, support member, and backplate which is simple and inexpensive to manufacture, and which provides a reduction in the fixed capacitance of the transducer. Generally, the motor assembly is located in a case to form acoustic chambers on opposite sides of the diaphragm. This type of transducer is suitable for hearing-aids, as well as for other uses.

According to one aspect of the present invention, the support member has a first side, a second side, and an aperture extending therethrough. A periphery of the diaphragm is connected to the second side of the support member such that a portion of the diaphragm is adjacent the aperture of the support member. The portion of the diaphragm that is not connected to the support member is capable of vibrating.

According to another aspect of the present invention, the backplate is mounted to the support member in a spaced relation. As such, the backplate is further spaced a distance from the diaphragm to provide a gap between the backplate and the diaphragm. Preferably, the entire backplate is spaced a distance from the diaphragm, enabling air movement between the diaphragm and the backplate and reducing unnecessary parasitic capacitance.

According to another aspect of the present invention, the backplate is charged. The charged material on the backplate cooperates with the vibrating diaphragm to develop a signal. An amplifier is electrically connected with a wire to the charged backplate. The wire allows the signal to be communicated to the amplifier which converts and amplifies the changes in capacitance into an electrical signal representative of those changes. The operation of the transducer is based on the change in capacitance between a fixed electrode, the backplate, and a movable diaphragm under the influence of external air (sound) vibrations. The change in this capacitance is proportional to the changes in air pressure and can be converted into amplified sound vibrations via the electronic amplifier described above.

According to yet another aspect of the present invention, a method for manufacturing the motor assembly is provided to attain accurate and proper spacing between the diaphragm and the backplate to reduce wasted output signal.

One object of the present invention is to provide a transducer motor assembly with a greatly reduced amount of parasitic electrical capacitance due to the elimination of support bumps to support the diaphragm and space the diaphragm from the backplate.

Another object of the present invention is to provide a transducer motor assembly which does not influence the transfer characteristics of the transducer.

Another object of the present invention is to provide a transducer motor assembly which does not waste potential output signal by having extra electrical capacitance in the transducer motor assembly, and which does not increase the noise level of the motor assembly.

Another object of the present invention is to provide a method for manufacturing such a transducer motor assembly which is efficient, inexpensive, and easily performed.

Other features and advantages of the invention will be apparent from the following specification taken in conjunction with the following drawings.

DETAILED DESCRIPTION OF THE PREFERRED EMBODIMENT

Figure 1:
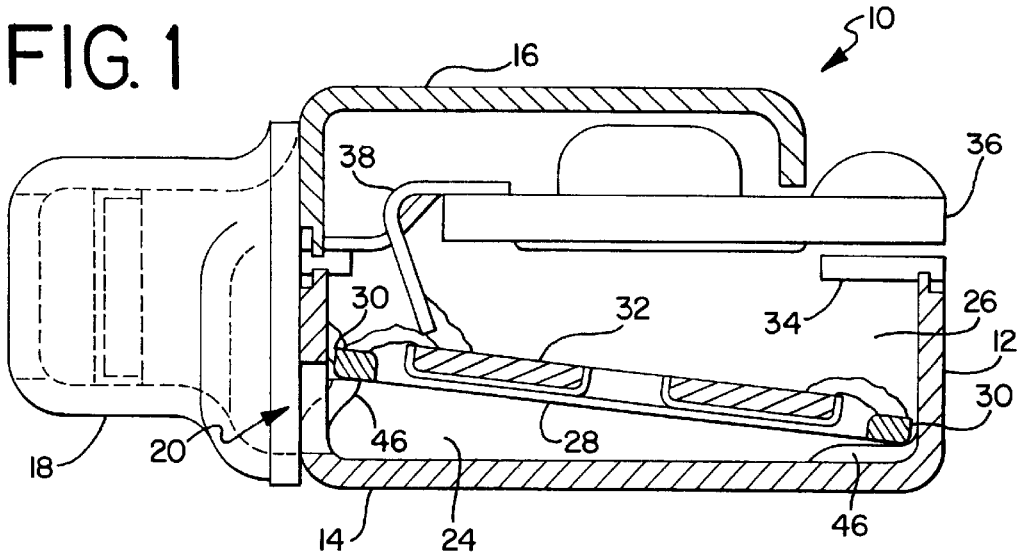
FIG. 1 is a cross-sectional elevation view of the acoustical transducer of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Referring now in detail to the Figures, and initially to FIG. 1, there is shown an acoustical transducer 10 having a case 12 with a cup-like lower housing 14 and a mating cover or top 16 which fits on the lower housing 14 and is fixed thereto to close the case 12. An acoustical signal input tube 18 is mounted to the case 12 and communicates with the interior of the case 12 through an opening 20 in the endwall of the lower housing 14 of the case 12. A motor assembly 22, also referred to as an electret assembly, is located in the case 12. The motor assembly 22 divides the interior of the case 12 into a first acoustical chamber 24 and a second acoustical chamber 26. The motor assembly 22 comprises a diaphragm 28, a support member 30, and a backplate 32. Additionally, the acoustical transducer 10 of the preferred embodiment includes a support plate 34 for supporting an amplifier 36 that is electrically connected to the backplate 32 with an input wire 38.

Figure 2:
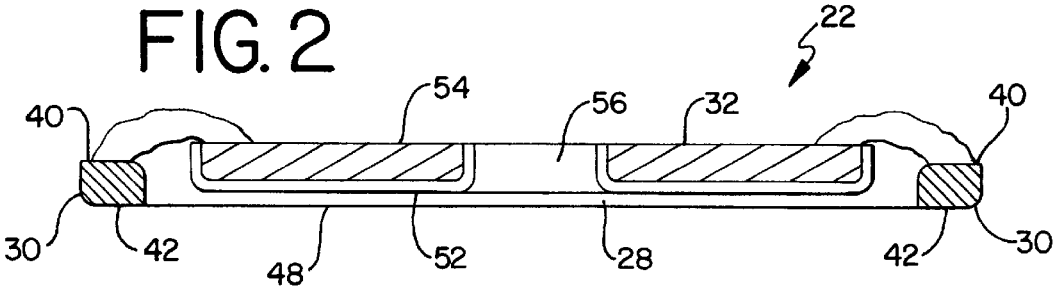
FIG. 2 is a cross-sectional elevation view of the motor assembly of the acoustical transducer of the present invention.
Figure 3:
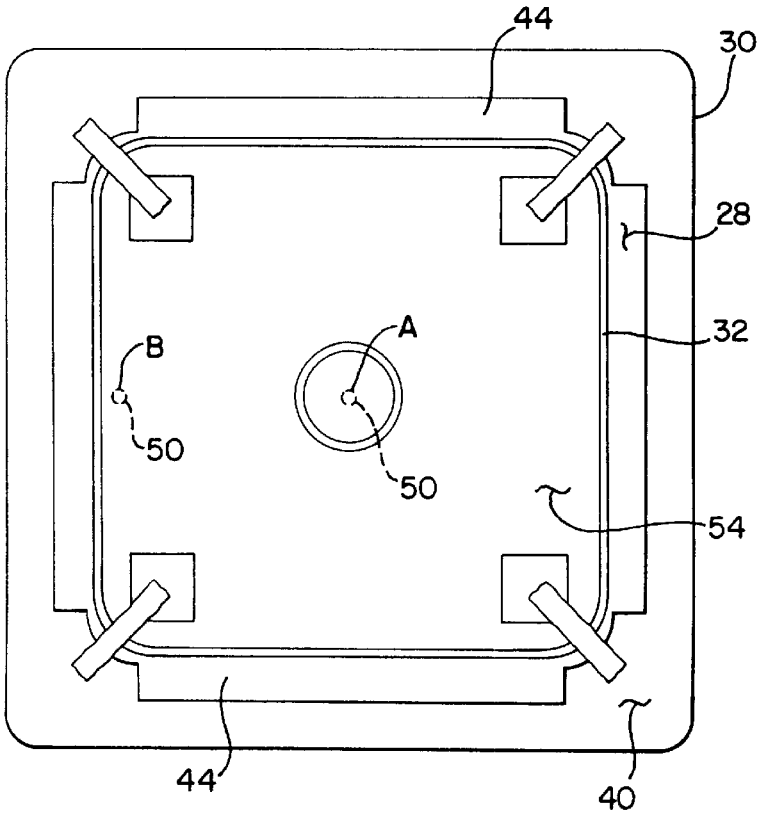
FIG. 3 is a top-view of the motor assembly of FIG. 2.

As illustrated in FIGS. 1–3, the support member 30, also referred to as a diaphragm ring, has a first side 40, a second side 42, and an aperture 44 extending from the first side 40 through to the second side 42. In a preferred embodiment, the support member 30 is made of a 0.006" thick hard brass; the first side 40 of the support member 30 is tin plated, and the second side of the support member 30 is lapped flat. A plurality of bumps 46 or protrusions in the lower housing 14 locate the support member 30 in the case 12. These protrusions 46, however, do not contact the portion of the diaphragm 28 adjacent the aperture in the support member 30. As shown in FIG. 1, after the support member 30 is located in the case 12, the support member 30 is grounded and secured to the lower housing 14 with a conductive cement.

The electret assembly 22 also has a diaphragm 28. The diaphragm 28 is connected to the support member 30 at a periphery portion which is adhered to the second side 42 of the support member 30 adjacent the aperture 44 in the support member 30. As such, the central portion 48 of the diaphragm 28 substantially covers the aperture 44 in the support member 30 and is capable of vibrating thereabout. Nothing contacts the central portion 48 of the diaphragm 28 adjacent the aperture 44 in the support member 30. The diaphragm 28 may be made of a 0.00006" thick polyethylene terephthalate film, commonly available under the trademark MYLAR, or of any similar material. A pierce hole 50 extends through the central portion 48 of the diaphragm 28 adjacent the aperture 44 in the support member 30. The pierce hole 50 provides barometric relief. Generally, one of two locations is utilized for the pierce hole, location "A" which is generally centrally located on the diaphragm 28, and location "B" which is located on the centerline of the diaphragm 28, adjacent the support member 30. In a preferred embodiment, the side of the diaphragm 28 adjacent the second side 42 of the support member 30 is coated with a metallizing layer of conductive material. One such conductive material is gold. The metallized layer of the diaphragm 28 forms an electrically active portion of the diaphragm 28, commonly referred to as the movable electrode. The electrically active portion of the diaphragm 28 together with the backplate determines the capacitance varying under the influence of air vibrations.

The backplate 32 is mounted to the support member 30 in a suspended manner such that the backplate 32 is spaced a distance from the diaphragm 28 to provide a gap between the backplate 32 and the diaphragm 28. In a preferred embodiment the spacing between the suspended backplate 32 and the diaphragm is 0.0018". The backplate 32 has a first side 52, a second side 54, and an aperture 56 extending from the first side 52 to the second side 54 to relieve pressure between the backplate 32 and the diaphragm 28. In the preferred embodiment, the backplate 32 is made of stainless steel which is soft annealed. Generally, the backplate 32 is first gold plated, and then the first side 52 of the backplate 32 is lapped flat, thus removing the gold material from the first side 52 of the backplate 32. After the first side 52 of the backplate 32 is lapped flat, a polarized dielectric film or electret material is coated or plated thereon. In a preferred embodiment, the lower side or first side 52 of the backplate, the surface of the aperture 56, and the perimeter of the backplate are plated with an electret material, which is Teflon in the preferred embodiment. As such, the coated backplate is referred to as the fixed electrode of the electret assembly. Additionally, in the preferred embodiment the coated backplate 32 is electrostatically charged as well with approximately 350 V. The dielectric film or electret material on the backplate 32 cooperates with the diaphragm 28 to develop a signal. As shown in FIG. 2, the entire backplate 32 is spaced a precise distance from the diaphragm 28 via cement bridges, enabling air movement between the diaphragm 28 and the backplate 32, and reducing capacitance. In such an embodiment the backplate 32 does not contact the diaphragm 28, and further the backplate 32 does not directly contact the support member 30. No use is made of protrusions in the backplate for spacing the backplate and the diaphragm. This is a stark contrast to prior motor assemblies wherein the backplate included a pattern of spaced protrusions on its lower surface which contacted the diaphragm to provide a precise spacing between the diaphragm and the electret film on the backplate. Conversely, in the identified embodiment there are no support bumps or protrusions to contact the diaphragm. Accordingly, parasitic electrical capacitance created by such support bumps in the prior art is greatly reduced or entirely eliminated. Further, a greater amount of the diaphragm 28 is free to move in response to sound since there are no elements contacting the diaphragm 28 adjacent the backplate 32. Testing has shown the such a construction provides a gain of over 3 db.

As shown in FIG. 2, the backplate 32 is suspended from the support member 30. Preferably an adhesive or some other connection means connects the backplate 32 to the support member 30 in a spaced relation. Most preferably, as shown in FIG. 3, cement is applied to each of the four corners of the backplate 32 and support member 30, respectively, in a bridge-like manner to hold the backplate 32 in place.

Figure 4:
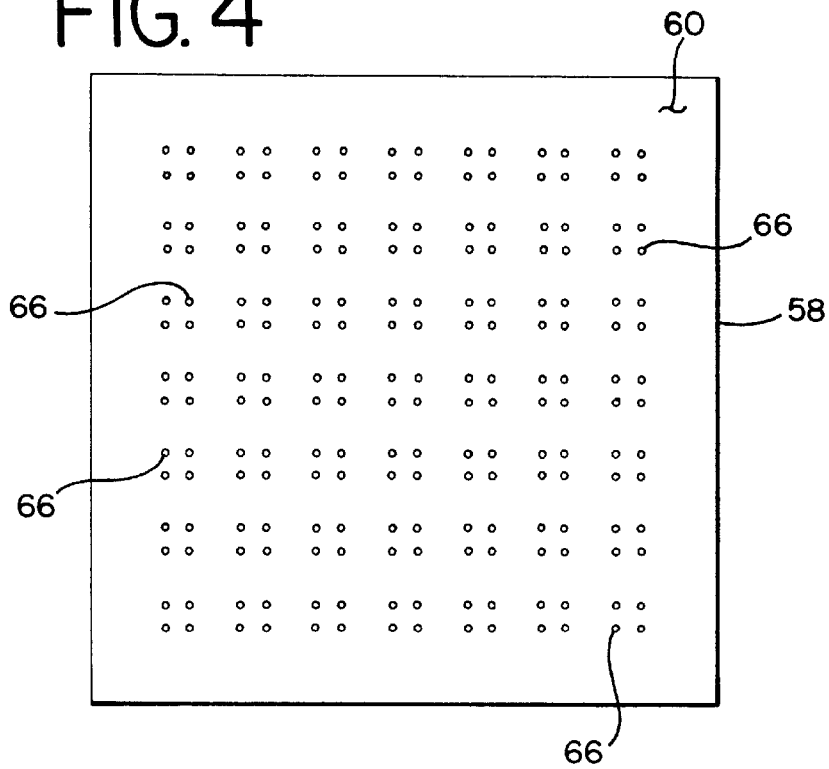
FIG. 4 is a top-view of a base member used in manufacturing the acoustical transducer of the present invention.

The manufacturing process, and elements thereof, for producing the motor assembly 22 of the present invention are illustrated in FIGS. 4–7. FIG. 4 displays a base block or base member 58. The base block 58 is made from a stainless steel bar approximately 0.125" thick. The base block 58 has a top surface 60 which is ground flat, and a plurality of protrusions 62 extending from the top surface 60. Instead of stainless steel the base block may be manufactured of any material which has a flat upper surface, including plastics. Further, the protrusions may be integral with the base block 58, or they may be separate elements. Additionally, the number of protrusions required to manufacture one motor assembly may vary dependent on the size and configuration of the protrusion. In the preferred embodiment, the protrusions 62 are formed from pins 64 which extend from the top surface 60 of the base block 58. The pins 64 are made from 0.014" diameter stainless music wire which has a radiused end with a flat on the center of the end of the pin 64. The radiused end assists in preventing damage to the diaphragm 28, and the flat assists in preventing damage to the Teflon on the backplate 32 when the pins 64 press against the diaphragm 28 film and backplate 32 during manufacture. The pins 64 are located in through holes 66 in the base block 58. In the preferred embodiment, four pins 64 are utilized for each respective motor assembly to provide accurate spacing between the diaphragm 28 and the backplate 32, and also to eliminate tipping and movement of the backplate 32 during manufacture. The pins 64 are cemented in place in the holes 66 and positioned so that the rounded and polished end of the pin 64 protrudes about the ground flat surface 60 of the base block 58 at the required distance, approximately 0.0018" in the preferred embodiment.

Figure 5:
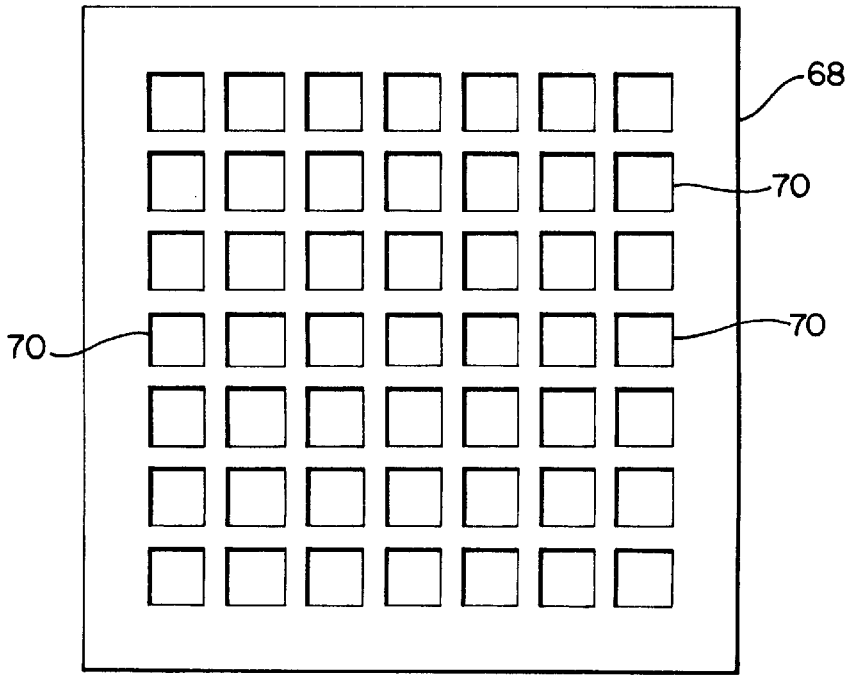
FIG. 5 is a top-view of an alignment plate used in manufacturing the acoustical transducer of the present invention.
Figure 6:
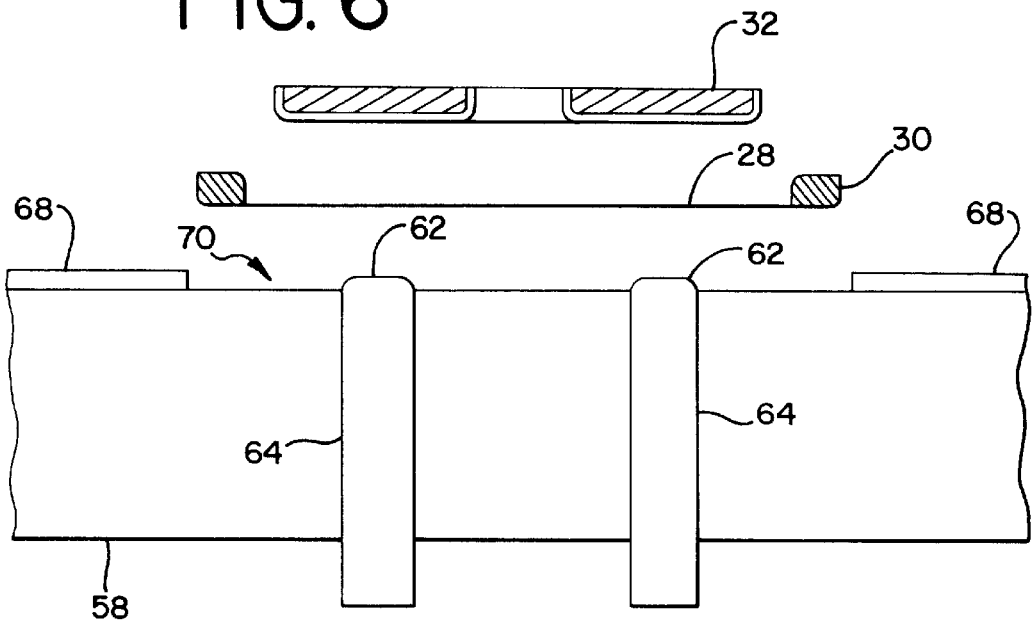
FIG. 6 is a side elevation view of part of the process of manufacturing the acoustical transducer of the present invention; and, FIG. 7 is a side elevation view of another part of the process of manufacturing the acoustical transducer of the present invention.

An alignment plate 68 is illustrated in FIG. 5. The alignment plate 68 is made from 0.003" thick stainless shim stock, and has a plurality of openings 70 therethrough. The pattern of openings 70 in the alignment plate 68 corresponds to the pattern of protrusions, however the openings are approximately 0.003" to 0.005" larger than the support member 30. The alignment plate 68 is placed on the base block 58 such that each of the pattern of protrusions 62, i.e., pins 64 in the preferred embodiment, extend through and is centered in a respective opening 70 in the alignment plate 68. The alignment plate 68 is then cemented in place to the base block 58. Alternately, the alignment plate 68 may be a projection integral with the base block 58, or may be any locating means cooperating with the base block 58 to locate the motor assembly on the protrusions 62 of the base block.

Figure 7:
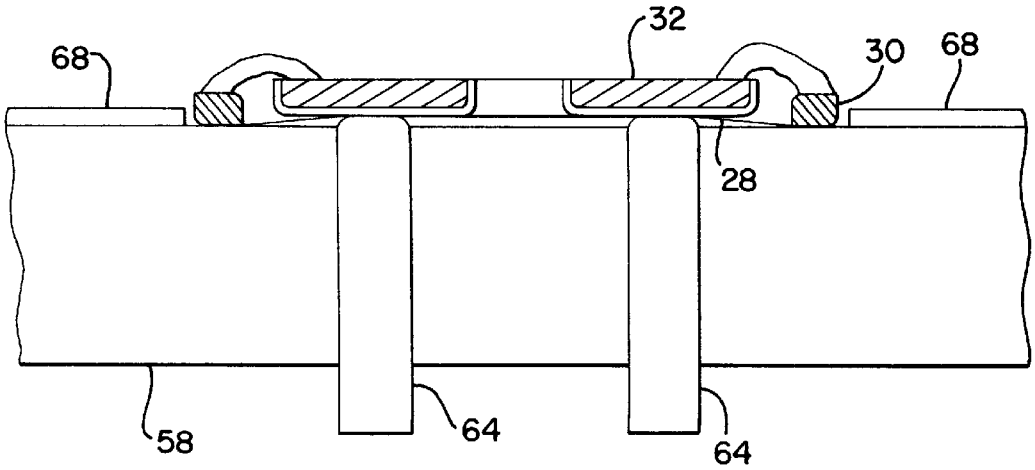

Once the above assembly tool is complete, a plurality of motor assemblies 22 may be simultaneously manufactured thereon together, and then mounted in separate cases 12. First, a support member 30 having a diaphragm 28 properly connected thereto is placed on the base member 58 such that the support member 30 is adjacent the top surface 60 of the base member, and the protrusions 62 of the base member contact the diaphragm 28. The alignment plate 68 accurately aligns the support member 30 and diaphragm 28 on the protrusions 62. It should be noted however, that prior to placement of components in the assembly took, the each of the manufacturing steps required for each separate component should generally be completed (i.e., the diaphragm is shaped to size, a pierce hole is created, and the diaphragm may have a metallizing layer adhered thereto). After the support member 30 and diaphragm 28 are located in the opening 70, and the diaphragm 28 is on the protrusions 62, the first side 52 of the backplate 32 is placed on the diaphragm 28. As shown in FIG. 7, the backplate 32 is supported by the protrusions 62 and is spaced a distance away from the top surface 60 of the base plate 58.

After the backplate 32 is properly located on the diaphragm 28 and adjacent the support member 30, the connecting means, preferably an adhesive, is applied in the proper locations to connectedly secure the backplate 32 to the support member 30. In the preferred embodiment, the adhesive is applied to each of the corners of the support member 30 as shown in FIG. 3. The support member 30 is then pressed down against the top surface 60 of the base block 58 (the support member 30 may be pressed down against the top surface 60 of the base block 58 prior to the application of the connecting means). As such, because the backplate 32 is seated on the protrusions 62, the backplate 32 is spaced in a plane a distance from the plane of the top surface of the base block 58. Once the adhesive hardens, the motor assembly 22 is removed from the base member 58 and the diaphragm 28 springs back to its proper configuration away from the backplate, as shown in FIG. 2. Accordingly, the backplate 32 is spaced a distance from the diaphragm 28, the distance being set by the height of the protrusions 62 above the top surface 60 of the base member 58, such that the backplate 32 does not contact the diaphragm 28.

It should be understood that the steps prior to the hardening of the adhesive connecting the support member 30 with the backplate 32 may be varied and interchanged. For example, the adhesive may be applied to the support member 30 and the backplate 32. Then, both the support member 30 and backplate 32 may be placed onto the assembly tool and clamped down.

The assembly tool serves a multitude of purposes, including centering the support member 30 and diaphragm 28 on the protrusions 62, and providing a means for maintaining the backplate 32 spaced apart at the proper distance from the diaphragm 28. As explained above, this spacing is critical to the performance of the transducer.

While the specific embodiment has been illustrated and described, numerous modifications come to mind without significantly departing from the spirit of the invention, and the scope of protection is only limited by the scope of the accompanying claims.

We claim:

1. A method for manufacturing a motor assembly for an acoustic transducer comprising the steps of:

providing a base member having a surface and a protrusion extending a distance from the surface;

providing a support member having an opening therethrough, and a diaphragm connected to the support member, the diaphragm covering a portion of the opening of the support member;

providing a backplate;

placing the support member on the base member such that the support member contacts the surface of the base member, and the protrusion of the base member contacts the diaphragm;

placing the backplate on the diaphragm such that the backplate is supported by the protrusion;

securing the backplate to the support member; and removing the motor assembly from the base member.

2. The method of claim 1, wherein the method of securing the backplate to the support member fixes the backplate a spaced a distance from the diaphragm.

3. The method of claim 1, further comprising a plurality of protrusions extending a distance from the surface of the base member.

4. The method of claim 1, wherein aligning members extend from the surface of the base member to align the support member on the base member.

5. The method of claim 1, further comprising the steps of:

providing an alignment plate having an opening therethrough; and, placing the alignment plate on the base member, the protrusion extending through the opening in the alignment plate.

6. The method of claim 5, further comprising the step of:

placing the support member within the opening of the alignment plate and on the surface of the base member such that the protrusion of the base member contacts the diaphragm.

7. The method of claim 1, further comprising the steps of:

pressing the support member down against the surface of the base member;

securing the backplate to the support member with an adhesive;

waiting for the adhesive to harden;

removing the support member and backplate from the base member; and, having the diaphragm spring back away from the backplate to space the diaphragm from the blackplate.

8. The method of claim 1, further comprising the steps of:

providing a plurality of apertures in the base member;

providing a plurality of support pins in the apertures of the base member, respectively, the support pins extending a distance from the surface of the base member, wherein the support pins contact the diaphragm when the support member and diaphragm are place on the base member.

* * * * *

UNITED STATES PATENT AND TRADEMARK OFFICE

CERTIFICATE OF CORRECTION

PATENT NO. : 6,684,484 B2
DATED : February 3, 2004
INVENTOR(S) : James Steven Collins It is certified that error appears in the above-identified patent and that said Letters Patent is hereby corrected as shown below:

Column 6,
Line 55, please delete “a spaced a distance” and insert -- a spaced distance --.

Column 8,
Line 11, please delete “are place on the base member” and insert -- are placed on the base member --.

Signed and Sealed this

Twenty-second Day of June, 2004

JON W. DUDAS
*Acting Director of the United States Patent and Trademark Office*